US006494789B2

(12) United States Patent
Chen

(10) Patent No.: US 6,494,789 B2
(45) Date of Patent: Dec. 17, 2002

(54) GOLF CLUB HEAD

(76) Inventor: Archer C. C. Chen, No. 501, 28th Road, Taichung Industrial Park, Taichung (TW)

( * ) Notice: Subject to any disclaimer, the term of this patent is extended or adjusted under 35 U.S.C. 154(b) by 94 days.

(21) Appl. No.: 09/791,743

(22) Filed: Feb. 26, 2001

(65) Prior Publication Data

US 2002/0160852 A1 Oct. 31, 2002

(51) Int. Cl.[7] ..... A63B 53/04; C22C 38/40; C22C 38/44; C22C 38/50

(52) U.S. Cl. ..... 473/324; 473/349; 473/345; 473/350; 148/325; 420/53

(58) Field of Search ..... 473/324, 349, 473/345, 346, 350; 148/325; 420/53

(56) References Cited

U.S. PATENT DOCUMENTS 3,251,683 A * 5/1966 Hammond
3,340,048 A * 9/1967 Floreen
3,861,909 A * 1/1975 Caton
4,125,260 A * 11/1978 Kanne
4,314,863 A * 2/1982 McCormick
5,000,912 A * 3/1991 Bendel
5,089,067 A * 2/1992 Schumacher
5,104,457 A * 4/1992 Viljoen
5,358,577 A * 10/1994 Uehara
5,569,337 A * 10/1996 Yoshida
5,630,888 A * 5/1997 Yoshida
5,714,114 A * 2/1998 Uehara
6,334,817 B1 * 1/2002 Ezawa

* cited by examiner

*Primary Examiner*—Sebastiano Passaniti
(74) *Attorney, Agent, or Firm*—Browdy and Neimark, P.L.L.C.

(57) ABSTRACT

A golf club head comprises a ball-hitting face made of a steel alloy containing maximum amounts of 0.03% of C by weight, 0.2% of Si by weight, 0.2% of Mn by weight, 0.2% of P by weight, 0.02% of S by weight, 10.5-11.0% of Cr by weight, 1.8-2.2% of Mo by weight, 9.5-10.5% of Ni by weight, 0.9-1.2% of Ti by weight, 0.5% of Al by weight, 0.1% of Cu by weight, 0.3% of $N_b$ by weight, 0.3% of B by weight, 0.01% of N by weight, 0.1% of V by weight, 0.1% of W by weight, and the rest being Fe. The steel alloy is made by a metallurgical method involving two vacuum melting processes. The texture of the steel alloy is mainly formed of martensite.

9 Claims, No Drawings

GOLF CLUB HEAD

FIELD OF THE INVENTION

The present invention relates generally to a golf club, and more particularly to a head of the golf club.

BACKGROUND OF THE INVENTION

The conventional golf club heads are generally made of stainless steel, such as SUS 630 or SUS 431 (The U.S. AISI Standard 630 type and 431 type). The process is carried out by a precision dewaxing method. The density of such material is greater, while the strength of such material is lower. As a result, the conventional golf club heads have a certain wall thickness to meet the strength requirements that the golf club head should not be too heavy, and that the volume of the golf club head should not be too large. As a result, the scope of the sweet spot of the ball-hitting face of the golf club head is substantially reduced, thereby resulting in an increase in the rate of the ball-hitting failure.

The golf club head of titanium alloy has a density smaller than that of the stainless steel head, and a strength equal to that of the stainless steel head. However, the titanium golf club head is relatively expensive and must be made by a special vacuum melting pouring method at a high cost.

SUMMARY OF THE INVENTION

The primary objective of the present invention is to provide a golf club head free of the deficiencies of the conventional golf club head described above.

The golf club head of the present invention comprises a face which is made of a steel alloy containing maximum amounts of 0.03% carbon by weight, 0.2% of silicon by weight, 0.2% of manganese by weight, 0.2% of phosphor by weight, 0.02% of sulfur by weight, 10.5–11.0% of chromium by weight, 1.8–2.2% of molybdenum by weight, 9.5–10.5% of nickel by weight, 0.9–1.2% of titanium by weight, 0.5% of aluminum by weight, 0.1% of copper by weight, 0.3% of niobium by weight, 0.3% of boron by weight, 0.01% of nitrogen by weight, 0.1% of vanadium by weight, and 0.1% of tungsten by weight, with the rest being iron. The steel alloy is made by the metallurgical method requiring two vacuum melting processes. The steel alloy is of a metal quality of martensite.

DETAILED DESCRIPTION OF THE INVENTION

The golf club head of the present invention comprises a ball-hitting face and a main body. The face is made of a steel alloy containing maximum amounts of 0.03% of C by weight, 0.2% of Si by weight, 0.2% of Mn by weight, 0.2% of P by weight, 0.02% of S by weight, 10.5–11.0% of Cr by weight, 1.8–2.2% of Mo by weight, 9.5–10.5% of Ni by weight, 0.9–1.2% of Ti by weight, 0.5% of A1 by weight, 0.1% of Cu by weight, 0.3% of $N_b$ by weight, 0.3% of B by weight, 0.01% of N by weight, 0.1% of V by weight, 0.1% of W by weight, and the rest being Fe.

The metallurgical process of the steel alloy involves the use of the high-tech VIM and VAR for removing the impurities that are contained in the steel alloy. As a result, a steel alloy of high purity and high toughness is attained. The metallurgical process calls for two vacuum melting processes, with the first vacuum melting process being carried out at a temperature ranging between 900 and 1100° C. Upon completion of the γ phase solution heat treatment, the texture of the steel alloy is formed of martensite and residual austenite. The steel alloy has a hardness of HRC 25–38, a tensile strength of 88–125 kgf/mm$^2$. The second vacuum melting process is carried out at a temperature ranging between 450 and 565° C. Upon completion of the time effect treatment, the texture of the steel alloy is formed of martensite and precipitate. With the removal of the precipitate, the steel alloy has a hardness of HRC 46–53, a tensile strength of 155–189 kgf/mm$^2$. The steel alloy has a metal quality of martensite. The face has a thickness of 1.6–2.2 mm. The steel alloy is used to make up at least a portion of the sweet spot of the ball-hitting face.

The main body of the golf club head of the present invention is made by the afore-mentioned steel alloy, or SUS 17–4 PH or SUS 15–5 PH stainless steel or pure titanium, titanium alloy, aluminum alloy. The main body is made by a precision casting in conjunction with the surface punching and pressing. The metal material is then inlaid.

The head of the present invention is suitable for use in a wooden or metal golf club.

The sample of the present invention is given a name "CH-1", which was tested in a series of experiments.

The material test of CH-1 was tested in comparison with the conventional materials of SUS630 and SUS431. The CH-1 was found to be superior to the conventional materials in terms of tensile strength and hardness. In addition, the CH-1 of the present invention has the lowest density of 7.715 g/cm$^3$. The face of the present invention has a thickness ranging between 1.6 and 2.8 mm. The face of the present invention is resistant to impact, crack, or depression. The conventional ball-hitting face of SUS431 or SUS630 must have a thickness of at least 2.7 mm. The face of the present invention is smaller in thickness and equal in weight to the conventional faces, the face of the present invention thus has a greater scope of the sweet spot. As a result, the golf club head of the present invention has a stable ball-carrying capability. The weight may be distributed at the bottom of the head, so as to lower the center of gravity to facilitate the swinging or the improving of inertia moment of the golf club head.

The golf club head of the present invention was also tested along with a golf club head made of a titanium alloy (β Ti 15–5–3). The test was carried out by Maruman Golf Co. of Japan in terms of ball-carrying capability, ball controllability, ballistic tendency, operational capability, ball hitting sound, and ball hitting sensation, with the perfect score being 10 for each test item. For details, please refer to Table 2. The CH-1 scores are higher than those of the conventional golf club head of titanium alloy (15–5–3), especially the ball hitting sound of 7.7 and the ball hitting sensation of 7.0.

The golf club head of the present invention has advantages. The present invention is smaller in thickness and weight. The reduction of the weight is confined to the bottom of the golf club head, so as to lower the center of gravity and to improve the moment of inertia of the golf club head. The golf club head of the present invention is made of the material smaller in density, thereby resulting in greater volume of the golf club head to widen the sweet spot of the ball-hitting face. The golf club head of the present invention has a better ball-carrying stability and a better inertia moment. The golf club head of the present invention is made of the material which is cheaper than the titanium alloy material.

TABLE 1

Material Comparison of Present Invention and Prior Art

| Property | Kinds of materials | | |
|---|---|---|---|
| | SUS630 | SUS431 | CH-1 |
| Density(g/cm$^3$) | 7.8 | 7.75 | 7.715 |
| Tensile strength(kgf/mm$^2$) | 136 | 80.2 | 184 |
| Tensile strength(kgf/mm$^2$) | 126 | 65.5 | 174 |
| Coefficient of Young(kgf/mm$^2$) | 19600 | 20000 | 20255 |
| Expansibility(%) | 15 | 20 | 13 |
| Hardness(HRC) | 36 | 45 | 48–52 |

Note: CH-1 is the product name of steel alloy of the present invention.

TABLE 2

Test Results of Present Invention and Prior Art

| Kinds of Head | Test Items | | | | | |
|---|---|---|---|---|---|---|
| | Ball-carrying distane | Control-lability | Ballis-tic tendency | Opera-tional capabi-lity | Ball-hitting sound | Ball-hitting sensa-tion |
| Present invention (CH-1) | 6.3 | 6.8 | 6.3 | 6.2 | 7.7 | 7.0 |
| Prior art (15-3-3) | 5.7 | 6.0 | 6.2 | 5.8 | 5.8 | 5.5 |

Note: CH-1 is the product name of steel alloy of the present invention.

What is claimed is:

1. A golf club head comprising a ball-hitting face made of a steel alloy containing maximum amounts of 0.03% of C by weight, 0.2% of Si by weight, 0.2% of Mn by weight, 0.2% of P by weight, 0.02% of S by weight, 10.5–11.0% of Cr by weight, 1.8–2.2% of Mo by weight, 9.5–10.5% of Ni by weight, 0.9–1.2% of Ti by weight, 0.5% of Al by weight, 0.1% of Cu by weight, 0.3% of $N_b$ by weight, 0.3% of B by weight, 0.01% of N by weight, 0.1% of V by weight, 0.1% of W by weight, and the rest being Fe;

said steel alloy being made by a metallurgical method involving two vacuum melting processes, with the texture of the steel alloy being formed of martensite and residual austenite after the γ phase solution heat treatment at a temperature ranging between 900 and 1100° C., the steel alloy having a texture which is formed of martensite and precipitate after a time effect treatment at a temperature ranging between 450 and 565° C.

2. The golf club head as defined in claim 1, wherein said ball-hitting face has at least one sweet spot formed of said steel alloy.

3. The golf club head as defined in claim 1, wherein said golf club head is a metal wooden club head.

4. The golf club head as defined in claim 1, wherein said golf club head is an iron club head made of iron.

5. The golf club head as defined in claim 1, wherein said golf club head further comprises a main body made of said steel alloy, SUS 17-4PH, SUS 15-5 PH, pure titanium, titanium alloy, or aluminum alloy.

6. The golf club head as defined in claim 5, wherein said main body is made of a precision casting in conjunction with a surface punching and pressing, and a metal material inlaying process.

7. The golf club head as defined in claim 1, wherein said steel alloy has a tensile strength of 15.5–18.9 kgf/mm$^2$.

8. The golf club head as defined in claim 1, wherein said steel alloy has a hardness of HRC 46–53.

9. The golf club head as defined in claim 1, wherein said ball-hitting face has a thickness ranging between 1.6 and 2.8 mm.

* * * * *